US006646564B1

(12) United States Patent
Azieres et al.

(10) Patent No.: US 6,646,564 B1
(45) Date of Patent: Nov. 11, 2003

(54) SYSTEM AND METHOD FOR REMOTE MANAGEMENT OF EQUIPMENT OPERATING PARAMETERS

(75) Inventors: Renaud Azieres, Paris (FR); Pascal Favier, Paris (FR)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/988,673

(22) Filed: Nov. 20, 2001

Related U.S. Application Data

(60) Provisional application No. 60/273,551, filed on Mar. 7, 2001.

(51) Int. Cl.[7] ..... G08B 21/00

(52) U.S. Cl. ..... 340/679; 340/506; 701/108; 701/174

(58) Field of Search ..... 340/679, 500, 340/501, 506, 511, 3.1, 539.22, 539.24, 3.43; 700/108, 110, 111, 174, 175

(56) References Cited

U.S. PATENT DOCUMENTS 4,847,894 A * 7/1989 Chanvin et al. ..... 279/104
5,225,997 A * 7/1993 Lederer et al. ..... 364/550
5,460,006 A * 10/1995 Torimitsu ..... 340/585
5,946,922 A * 9/1999 Viard et al. ..... 62/126
6,097,429 A * 8/2000 Seeley et al. ..... 348/154
6,437,691 B1 * 8/2002 Sandelman et al. ..... 340/506

* cited by examiner

*Primary Examiner*—Toan Pham
(74) *Attorney, Agent, or Firm*—Burns, Doane, Swecker & Mathis, L.L.P.

(57) ABSTRACT

The present invention is directed toward providing a system for the remote monitoring and control of operating equipment. Through a series of sensors located on or near the equipment, a plurality of operating and production parameters are read and metered. Should any of the readings exceed predetermined levels, an alarm signal is triggered, thereby notifying service personal located remote from the equipment site. Through the automated resources at the monitoring site, the system automatically logs the readings, events, and alarms; communicates alarms to the appropriate personnel dependent upon the nature of the alarm, the type of equipment involved, and the location of the equipment. Service and maintenance information and aids are available to personnel at the equipment site through a communication network to the remote monitoring site. Based on the alarm condition and equipment readings from the sensors, the system can automatically transmit commands to adjust the operating controls on the equipment to resolve the alarm condition.

23 Claims, 2 Drawing Sheets

SYSTEM AND METHOD FOR REMOTE MANAGEMENT OF EQUIPMENT OPERATING PARAMETERS

CROSS-REFERENCE TO RELATED APPLICATION

This application is based upon and claims priority to U.S. provisional application No. 60/273,551, filed Mar. 7, 2001, the contents being incorporated herein by reference.

BACKGROUND OF THE INVENTION

1. Field of the Invention

The present invention relates to the monitoring of operating equipment and, more specifically, to the automated monitoring and control of equipment operating at a remote site.

2. Description of the Related Art

The cooling of food products has long been known to help prolong the healthy life of the food and to slow the growth of harmful substances, such as bacteria. While blocks of ice manually packed around food were first used to keep food cool, mechanical refrigeration was introduced in the $19^{th}$ century to more efficiently and reliably cool food, the rooms in which the food was stored, and the rooms in which the food was prepared. More recently, as the need to provide colder temperatures than traditional evaporative refrigeration equipment could produce, cryogenic equipment was developed and refined to produce temperatures well below 0° Celsius. In addition to food preservation, other aspects of food product processing and preparation have been facilitated by cryogenic processing, including food slicing, grinding, and glazing. Because of the critical products and processes protected by contemporary refrigeration and cryogenic systems, the continuous and proper operation of these systems is constantly monitored to identify and remedy any operational problems quickly. This necessitates dedicated, knowledgeable people constantly on staff to monitor and fix any problems that may arise. However, many sites operating such cooling equipment can neither afford or justify having the required skilled technicians on site to diagnose and remedy equipment problems as they arrive. Furthermore, as cooling equipment becomes more complex, even trained service personnel lack the knowledge to quickly diagnose and efficiently fix the multitude of equipment malfunctions that may arise. Even minor deviations from the proper operating parameters for the equipment, while visually indistinguishable to the user or technician, can signal a deteriorating condition that may ultimately bring down the operation of the equipment, with potentially large and damaging losses to not only the cooling equipment but, more importantly, also to the products and processes protected by such cold temperatures.

These and other drawbacks, problems, and limitations of conventional remote management of equipment are overcome according to exemplary embodiments of the present invention

SUMMARY OF THE INVENTION

Exemplary embodiments of the present invention are directed to a system and method for remote monitoring and control of the operating parameters and performance levels for equipment, including cooling equipment such as cryogenic freezers and tunnels. The inventive system allows one or more users to monitor the operation and performance of equipment located at multiple sites that can be geographically remote from the user. Various sensors and meters placed on or near the equipment constantly, or on demand, monitor a plurality of operating conditions and report the readings locally and remotely. In addition, operating process conditions and product characteristics such as product temperature, color, weight, and bacteriological state can be monitored. Sensor readings that exceed a predetermined standard result in the generation of an alarm signal, whether audible, visible, electronic, logged, or some combination thereof. These alarm indicators can be displayed or sounded locally and remotely to advise the responsible personnel that potential problems may exist. Out-of-range conditions can also trigger an automated response whereby the operating controls of the equipment are automatically adjusted in response to the sensor readings. Monitoring and operational access to the system is provided across a series of networks, computers, and graphical user interfaces to provide authorized users a measured and secured access to the monitoring accomplished by the inventive system, the information captured by the system, and the remote controlling facilitated by the system. The security is provided not only by password-controlled access but also by the encryption of transmitted information and by the restriction of access and control based on the location from which access is sought.

Servicing and maintenance of the equipment, whether scheduled or triggered by an alarm condition, can be managed remotely by communication links and remote information files that permit remote monitoring and instructing of the servicing operations occurring at the equipment site. Both remote and local service personnel have secured access to historical data and ideal operating conditions related to the equipment. The degree of access is based on each person's respective level of authorization, either through personal logon identifications or through their respective points of entry into the system.

Exemplary embodiments of the invention are directed toward a system and method for remote monitoring of equipment, including the steps of generating sensor readings from at least one sensor on a piece of equipment; transmitting the sensor readings to a processor; processing the transmitted sensor readings against a predetermined standard to determine whether any transmitted sensor readings violate the standard; and automatically transmitting a signal to the equipment site should any of the transmitted sensor readings violate the standard.

As a further feature of the present invention, the sensor measures one or more of equipment operating conditions, equipment environmental conditions, and product characteristics; and the sensor readings are transmitted to a processor remote from the equipment location. Access to the transmitted sensor readings is limited based on one or more of user logon identifier, user status identifier, and user processor location.

An alternative embodiment of the invention is directed toward a system and method for a method for automated control of equipment, including determining desired performance standards for a piece of equipment; generating sensor readings from the piece of equipment; comparing the generated sensor readings against the desired performance standards; transmitting commands to set operating controls on the equipment should the generated sensor readings violate the desired performance standards, wherein the transmitted commands are determined based on prior sensor readings and operating control settings from like pieces of equipment and wherein the transmitted commands automatically set operating controls on the piece of equipment such that the desired performance standards are achieved.

As a further feature of the present invention, the determined performance standards include operating control settings, recorded at the central location, known to achieve certain sensor readings on like equipment.

BRIEF DESCRIPTION OF THE DRAWINGS

These and other objects and advantages of the present invention will become more apparent and more readily appreciated from the following description of the preferred embodiments, taken in conjunction with the accompanying drawings, wherein.

DETAILED DESCRIPTION OF THE PREFERRED EMBODIMENTS

Figure 1:
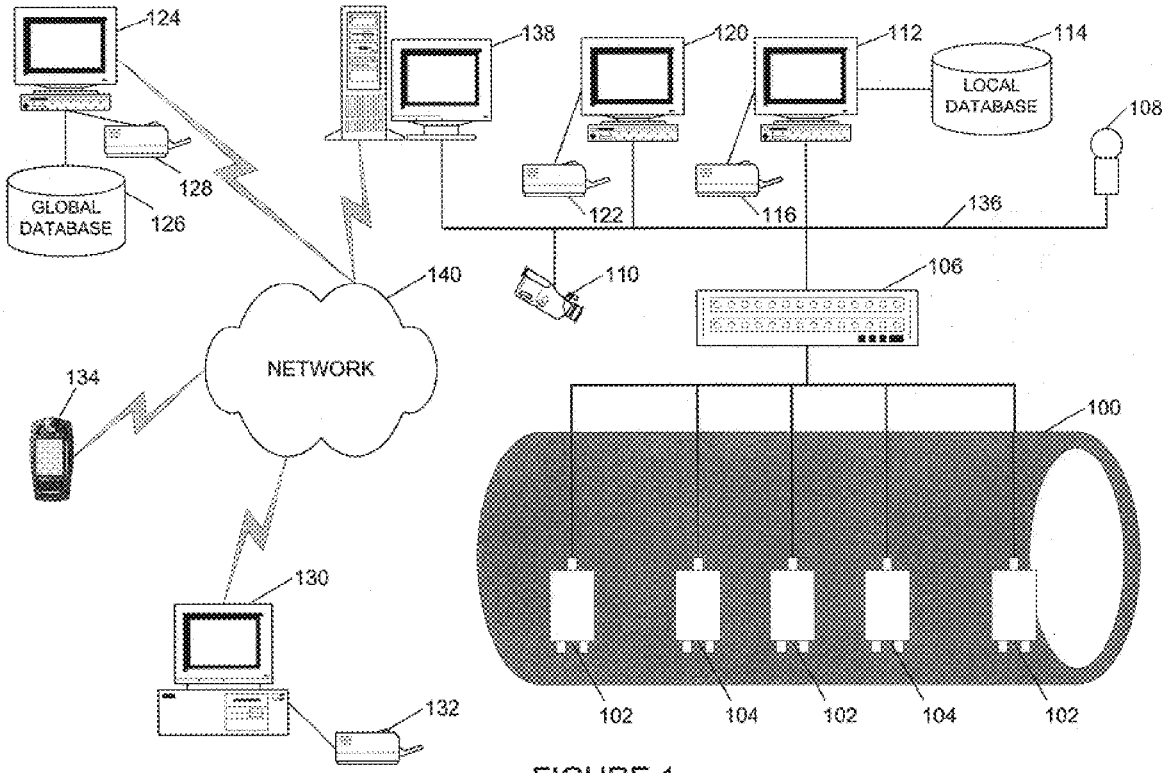
FIG. 1 shows a component diagram of an automated remote equipment management system configured in accordance with an exemplary embodiment of the present invention.

Referring initially to FIG. 1, there is shown a component diagram of an automated remote equipment monitoring and control system configured in accordance with an exemplary embodiment of the present invention. The equipment to be monitored and controlled, i.e., managed, is represented by equipment 100, which can, for example, be a cryogenic tunnel utilized in the preparation and processing of food products. Alternatively, the present invention can be readily implemented on any piece of equipment 100 or on any complex of equipment components, such as all the machines and devices that may comprise an assembly line, that is susceptible to measurement, monitoring, controlling, and maintaining. Connected to the equipment 100 at one or more location are sensors 102 for monitoring various parameters and conditions that are indicative of equipment operation and performance. For example, as regards a continuous cryogenic tunnel, possible parameters for measurement and reporting can be electrical amperage draw; internal temperature of the tunnel; temperature of the cryogenic gas, such as nitrogen, as the gas is released into the tunnel; tunnel temperature at the level of the conveyer belt; speed of the conveyer belt; temperature of the room in which the tunnel is operating; and item count per hour of products being processed through the tunnel. Some sensors 102 can be installed along a food processing line and continuously measure different operating process conditions and product characteristics, such as temperature, color, weight, and bacteriological state. The sensors 102 can be affixed to the equipment 100, can be connected to the equipment 100 through wired or wireless leads, or can be located proximate to the equipment 100 for reading conditions that are indicative of the environment in which the equipment 100 is operating, such as room temperature and humidity or floor water level. The sensors 102 can also be meters that display readings to equipment operators, maintenance personnel, and remote monitoring personnel. While only three sensors 102 are shown in FIG. 1, the monitoring system of the present invention can accommodate literally hundreds of sensors 102, placed strategically throughout the equipment 100 and throughout the environment or site where the monitored equipment 100 is located.

Each of the sensors 102 transmits its generated signals into a programmable logic controller 106. The programmable logic controller 106 serves as an intelligent portal on a network 136 through which the signals from the sensors 102 pass to be stored on a local database 114 or transmitted across various networks 136 or 140 for storage on a remote global database 126 and for viewing by various equipment operator, monitor, and maintenance personnel on personal computers, terminals, and workstations 112, 120, 124, and 130. Additionally, with the expanding capabilities of personal digital assistants (hereinafter "PDA") and mobile telephone handsets (the PDA's and mobile phones being hereinafter collectively referred to as "portable devices"), sensor signals can also be transmitted to and accessed by means of such devices 134. The controller 106 includes a processor that can be programmed to detect when a reading from a sensor 102 violates or exceeds a predetermined range or standard for the particular parameter being sensed, at which time the programmable logic controller 106 can activate a local alarm 108 and can automatically generate alarm signals or warning messages to be transmitted to various monitoring terminals, such as a personal computer 112 on the network 136 and located near the equipment 100; a workstation 120 located within the enterprise and accessible via the network 136; a remote personal computer 124 accessible via the network 140 for maintaining a remote global database 126; a work station, computer, or terminal 130 accessible via the network 140 for possibly being a call center; and portable devices 134 accessible via the network 140. Each of the devices residing on the network 140, if properly authorized, can receive sensor data from the programmable logic controller 106 through a secure access server 138.

It is understood that each of the computing devices 106, 112, 120, 124, 130, and 134 have at least one processor and both reception and transmission means. To differentiate between the various processors and transmission means, a designation of first and second processors and first and second transmitters, for example, may be utilized herein to differentiate between the features of the various devices.

The aforementioned networks 136 and 140 can be any combination of hard-wired and wireless networks, including local area networks, wide area networks, private networks, public networks, intranets, extranets, and the Internet. Access across the networks can be through a dial-up telephone line, a wireless link, a hard-wired connection, or any combination thereof. Remote access to the system is available by any number of known communication protocols, including wireless (receipt of Short Message System messages on mobile telephone handsets, hereinafter "SMS"), Wireless Application Protocol (hereinafter "WAP"), and wireless Internet (Bluetooth). For those networked users who lack direct or dedicated computer access to the information network provided by the invention, the controller 106 can be programmed to format and transmit email messages to predetermined and identified users to so inform these users of relevant operating or alarm conditions occurring on the equipment 100. Alternatively, any of the computers 112, 120, 124, 130, or 134 can include the feature of being able to automatically forward information received from the controller 106 to users in the form of email messages.

In one embodiment of the invention, the processor of the programmable logic controller 106 can be programmed to modify the actuators or operating controls 104 of the equipment 100 in response to various sensor 102 readings, thereby automatically controlling all aspects of the operation of the equipment 100 in direct response to the readings of the sensors 102. For example, the flow of the cryogenic gas can be automatically incrementally increased if the temperature inside the equipment 100 becomes too warm. The equipment control modification feature can also include shutting down the equipment 100, preferably in a controlled, non-damaging sequence and time frame, in response to specific, predetermined out-of-range or alarm conditions. By means of this inventive system, the programmable logic controller 106 serves as a central hub for the monitoring and controlling of the equipment 100 by being connected to all sensors 102 for receiving operating parameters of the equipment 100; being connected to all actuators or operating controls 104 to direct operational control of the equipment 100; and being connected across networks 136 and 140, respectively, to a local database 114 and a global database 126 for transmitting to storage all data obtained by the sensors 102. Additionally, each of the networked personal computers, workstations, terminals, and portable devices 120, 124, 130, and 134, with proper authorization, can access the programmable logic controller 106 across the networks 136 and 140 to receive data from the sensors 102 and to transmit commands to modify the settings of the operating controls 104 to effect changes in the operation of the equipment 100. Data and commands flowing among these various computers and networks can be secured through encryption techniques and can be subject to firewalls to control access.

Monitoring and command access to the system is further secured through a series of passwords, logon identifiers, and personal identifiers issued to the users of the system and to the various locations of the monitoring and access devices as represented by computers, workstations, and portable devices 112, 120, 124, 130, and 134. The type of data a user can view and the types of commands a user can issue by means of the user's computer 112, 120, 124, 130, or 134 is a function of the user's security access level. In addition to the traditional logon identifier and password for personally identifying a user and obtaining the user's particular security access level from, for example, the global database 126 or the local database 114, the inventive system can detect the origin of a query, such as a user accessing the system from the local personal computer 112 across a local area network 136, or a user sending commands from the processor 130 in a remote call center across a wide area network 140 such as the Internet. Based on the location of the user or the particular processor by which the user is accessing the inventive system, the system will grant a predetermined level of access, as obtained from the database 126 or 114. Further, a user's logon identifier can establish the user's status to the system. For example, a user can sign on as a manager and be granted a commensurate level of access based on this user status identifier. Endowing users with a specific level of authority by one or more of a combination of logon identification, user classification, and access location not only adds to the security of the monitoring and control functions but also permits the system to customize the access for each user. By way of example and not limitation, a user logged on as a manager on the remote computer 124 can be granted access for viewing certain data on the remote database 126 and real-time data from certain sensors 102 by virtue of the user's status as a manager but can be denied operational authority over the controls 104 because of the user's logon through the remote computer 124. In another example, a particular remote user on a personal computer 130 may be interested in only a finite number of pieces of equipment 100 and can correspondingly tailor the information and layout presented on the graphical user interface of the personal computer 130 to best serve his or her needs.

One or more personal computers 112 are available at the equipment 100 site for receiving data transmitted from the programmable logic controller 106 in addition to receiving alarm signals from the controller 106. The personal computer 112 can be used by equipment operators and equipment maintenance personnel to efficiently monitor and control the operation of the equipment 100. The display of the personal computer 112 can be programmed to constantly display selectable readings from the sensors 102, thereby providing a constant, real-time display of the operating conditions and performance of the equipment 100. The processor of the personal computer 112 can also be programmed to compare the readings from the sensors 102 against a predetermined standard range for each sensor 102. The acceptable range of each operating parameter for this comparison is preferably downloaded from the local database 114 but could, alternatively, be accessed from a global database 126 across the network 140. In the latter application, the acceptable operating range can be automatically calculated based on operating data, including sensor readings, received across the networks 136 and 140 from other installations of like equipment 100. In this manner, the operation of the equipment 100 can automatically be compared against not only absolute parameters but also relative parameters based on the operational results from like equipment 100 operating within the enterprise, the results being stored on the remote database 126. Upon detecting an out-of-range condition, the personal computer 112 can display an error message and/or generate an audible alarm signal. For example, in addition to activating the alarm 108, the personal computer 112 can display on its graphical user interface an appropriate message, such as a particular sensor reading being worse than any corresponding reading on similar equipment in the enterprise or instructions to service personal for correcting the out-of-range condition.

The personal computer 112 can also be utilized locally by the operators and maintenance personnel to communicate with the programmable logic controller 106 to enter commands and instructions to be directed to the programmable logic controller 106. The entered commands and instructions can modify the programming of the programmable logic controller 106 to change how the controller 106 responds to various equipment sensor readings and alarm conditions, as detected by the sensors 102. The entered commands and instructions can also instruct the controller 106 to directly modify the operating controls 104 of the equipment 100, thereby manually controlling the operation of the equipment 100. The personal computer 112 can also be used to modify the acceptable operating ranges for each operating parameter for the equipment 100 as maintained on the local database 114. While not required by the present inventive monitoring and control system, the personal computer 112 is envisioned to be located in the proximity of the equipment 100 to permit local equipment operators and maintenance personal immediate and efficient access to real-time and historical data regarding the operating conditions and environment of the equipment 100 and means to conveniently adjust the operating controls 104 of the equipment 100. Access to control of the equipment is provided to the operator of the personal computer 112 through the programmable logic controller 106 and the controls 104, with trouble-shooting menus on the personal computer 112 being dynamically changeable so the operator is guided through selected operating and maintenance paths of action for safety and efficiency. Each of the display and command entry features of the personal computer 112 are secured by a hierarchy of authority levels that are accessible through appropriate logon identification of username and password. Only the highest level of authority permits modification of the operating controls 104 of the equipment 100 through the personal computer 112.

Also connected to the personal computer 112 is a camera 110. The camera 110 can be activated through the personal computer 112 for displaying a real-time image of the equipment 100 and the room in which the equipment 100 is located. Alternatively, certain pre-determined conditions detected on the equipment 100, such as excessive temperature or a shut-down, can automatically trigger the activation of the camera 110 and the subsequent recording of the images. Authorized personal utilizing the personal computer 112 can direct the camera through its motor-controlled mobility to view selected parts of the equipment 100 or the equipment room. Similarly, the programmable logic controller 106 can be programmed to direct the camera to automatically direct its lens to a particular portion of the equipment 100 or the equipment room that is generating an out-of-range reading from a sensor 102. The images captured by the camera 110 can be stored on the local database 114 for archiving and for later viewing and analysis.

The data from the sensors 102 is transmitted through the programmable logic controller 106 for storage on a local database 114, where the data is available for subsequent access and analysis by the personal computer 112, with the data or the results of the analysis being available for printing on a printer 116. In this manner, all sensor readings are recorded, and a historical database is established and maintained to log equipment operation data, including alarm occurrences and periodic equipment status checks that can be initiated automatically by the programmable logic controller 106 or by the personal computer 112.

The data from the sensors 102 and the camera 110 is also available for being transmitted across the network 136 for remote viewing on the personal computer/workstation 120. Computer 120 is envisioned as being one or more computers available at the site of the equipment 100 but not necessarily closely proximate to the equipment location. Through this resource, personnel near the equipment site and with proper authorization can view the equipment processing parameters as generated by the equipment sensors 102. Commands to be routed through the controller 106 to the controls 104 can be submitted through the computer 120 with a proper authority level, as determined by a personal logon id, a user's status id, and/or the location id from the computer 120. Similarly, the camera 110 can be directed by the computer 120 through the network 136 to view selected portions of the equipment and equipment environment.

The data from the sensors 102 and the camera 110 is also available for being transmitted through the network 136 and the secured access server 138 across the network 140 for remote viewing, processing, and storage at several computer sites. For example, the computer or terminal 124 can be located at the enterprise's home office or central location, with the global database 126 archiving all operating data and camera images from all equipment sites throughout the enterprise. In this manner, company executives at a headquarters location can access real-time and historical equipment operating information for any monitored piece of equipment 100 at any or all of the company's operating locations. With proper logon authority, either by personal logon id, user status id, and/or location id, a user on the computer 124 can view data from the sensors 102 and the camera 110 in real-time and can issue commands over the networks 140 and 136 to the controller 106 for A manipulating the equipment controls 104.

Periodically, the operating data from all like equipment locations is transmitted to and stored on the global database 126 and is analyzed to determine acceptable equipment operating ranges or standards, with these values subsequently being transmitted by the computer 124 across the networks 140 and 136 for storage on the local database 114 and for programming the personal computer 112 and the programmable logic controller 106 for comparison against readings from sensors 102. Equipment operating controls settings are also transmitted to and stored on the global database 126 from the various equipment sites. These operating controls settings are tied to corresponding sensor readings by time stamp and equipment identifier. In this manner, a database of equipment controls settings is established that is known to produce particular sensor readings. Therefore, when the readings generated by a particular sensor are out-of-range, the database 126 or 114 can be queried by the processor of one of the computers 112, 120, 124, 130, or 134 or the controller 106 to determine the proper controls settings to produce a sensor reading in a desired or standard range. The computer 124 has a printer 128 for outputting equipment operating data, global operating results, camera images, a command log, computed acceptable equipment sensor and operating ranges, and operating controls settings corresponding to optimum sensor readings.

The computer or terminal 130 can, for example, be located at a remote call center responsible for monitoring and maintaining the equipment 100. Out-of-range conditions detected by the controller 106 would activate an appropriate message on the graphical user interface of the computer 130 and could also sound an audible alarm at the computer 130 site. The user of the computer 130, with proper logon authority, can view the readings from the sensors 102 and can direct the camera 110 to create a video connection between the equipment site and the call center to provide images of the equipment site to help diagnose any problems signaled to the computer 130. Commands can be issued from the computer 130 across the networks 140 and 136 and through the controller 106 to the controls 104 to remotely modify the operating settings and parameters of the equipment 100. This feature permits company personal and/or manufacturer service personnel located in another facility to remotely monitor and control the equipment 100, even to the extent that no one is required to be on site where the equipment 100 is located. Additionally, instructions and/or queries can be routed from the computer 130 to the graphical user interface of the on-site computer 112 to instruct on-site maintenance and repair personnel the proper steps to take to resolve any out-of-range condition. These error conditions and the resultant responses entered through the computer 130 can be stored on the computer 130 and can be uploaded to the remote global database 126 and can be printed on either or both of the remote printers 132 and 128.

Data reception and command issuance and transmission is also provided by means of portable devices 134. Because of the relatively limited display, keyboard, and memory facilities of these devices, an abbreviated data set is available for viewing by these devices across the networks 136 and 140. As with the computer 112, 120, 124, and 130, the portable devices 134 have command capability, with proper authorization by personal logon id, user status id, and/or location id, for issuing commands to the equipment controls 104 through the programmable logic controller 106 and to the camera 110 across the network 136. Data and command access through the portable devices 134 is particularly useful for the traveling executive or service manager who wants to periodically monitor the operating conditions of various pieces of equipment located around the world. Additionally, through this resource, a service manager can be contacted to help resolve a particularly troublesome problem that the call center at computer 130 has not been able to fix.

Access to the monitoring and control features of the present invention by means of various personal computers, terminals, workstations, and portable devices 112, 120, 124, 130, and 134 is routed through the programmable logic controller 106, which can detect the source of any inquiry or command and the destination of any data. The controller 106, therefore, either through its own logic and storage facilities or through the data available from the local database 114, can control access to the monitoring and control features of the invention. In this manner, for example, selected control authority can be limited not only by logon identification but also by the source of the inquiry or the commands. In addition to users at various computers 112, 120, 124, 130, and 134 initiating access to the monitoring and control features of the present system, the programmable logic controller 106 can initiate communication to selected computers 112, 120, 124, 130, and 134 under specific conditions, such as serious out-of-range conditions that threaten the safety of equipment personnel or the integrity of the equipment. Under such conditions, the controller 106 initiates communication to a predetermined list of computers 112, 120, 124, 130, and 134, displaying a warning or alarm message on the screen of the corresponding device and/or activating an audible alarm on or at the site of the selected devices. As discussed above regarding portable devices 134, the computers and terminals in electronic contact with the controller 106 need not be limited to conventional computer-style terminals and can include many types of communication devices, such as cellular telephones, pagers, and personal digital assistants. For example, the controller 106 can access an authorized cellular telephone 134 with use of a unique ringing tone and display of an appropriate alarm message. The programmable logic controller 106, using information in its own memory or gleaned from the local database 114, can also access a series of computers 112 and remote computers 120, 124, 130, and 134 during such alarm conditions, successively contacting additional computers in a predetermined list until a response is received.

The technology used for accessing the monitoring and control features of the present invention through the remote terminals 124 and 130 is based on Java applets and is fully compatible with Internet standards. A terminal user, with proper authority, utilizing a browser, on an Internet terminal 124 or 130 anywhere in the world can access all the features of the present equipment management system. Moreover, the technology can differentiate whether the connection is remote (over a dedicated phone line, via the Internet or an intranet, or via wireless communication) or local (the user is standing in front of the personal computer 112 next to the equipment 100).

Information available to the users of the various computers 112, 120, 124, 130, and 134 having access to the system can be customized, based on logon authority and particular computer site. For example, real-time data can be made available to equipment operators; machine-specific and alarm condition-specific maintenance instructions can be made available to equipment operators; historical maintenance reports can be made available to maintenance personnel; production reports can be made available to plant managers; invoice and billing reports can be made available to sales and accounting personnel; and performance and repair trend reports can be made available to capital equipment planning personnel.

The present inventive system provides for one or several central network servers 138 permanently connected to the Internet. These servers act as a portal for customers and as an information gateway for accessing and retrieving data from a large amount of equipment 100 (freezers, cryogenic tunnels, sensors on the food chain, etc.) situated at different, geographically remote customer sites. Different communication pathways can be used as described above to route and access this data, including direct phone connection (wire or wireless), virtual private networks (hereinafter "VPN"), extranet, intranet, Internet, radio, and satellite. Note that depending on the communication link, the connection can be permanent or can be triggered by the controller 106 (such as when an alarm condition is detected), or by the server 138 (such as during a programmed schedule for data retrieval and archival). Connecting the present equipment monitoring and control system to a plurality of networks and communication links through a secured pathway enables the creation and delivery of multiple electronic services, such as e-services, e-commerce, and e-business applications.

Figure 2:
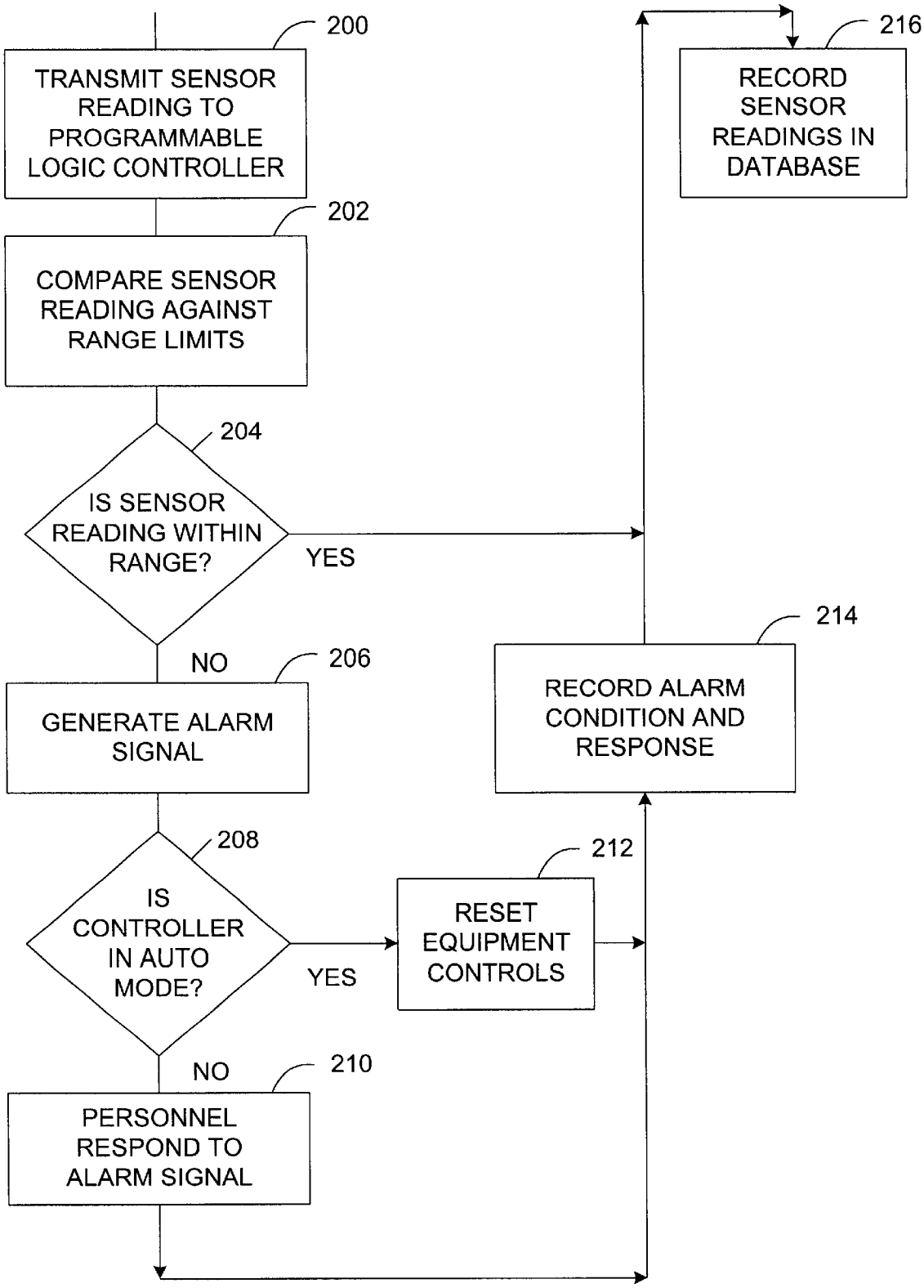
FIG. 2 shows a block flow chart of an exemplary method for remotely managing equipment.

Referring now to both FIGS. 1 and 2, the operation of a preferred embodiment of the present invention will be discussed. For purposes of example only and not limitation, the equipment 100 will be described as a continuous cryogenic tunnel for the flash freezing of food products as the products pass through the tunnel on a conveyer belt. A sensor 102 generates a reading representative of an operating condition on or proximate to the equipment 100 and transmits the reading to the programmable logic controller 106 at step 200. The sensor 102 is, for example, located near the surface of the conveyer belt in the cryogenic tunnel and detects the temperature at the conveyer belt surface one foot from the front of the tunnel. This particular sensor reading reflects the temperature to which the food products being passed through the tunnel are subjected; the temperature required to be sufficiently low to flash freeze the food products on the conveyer belt. The reading can be initiated continuously or periodically, or can be sent on demand based on a signal from the controller 106. The demand signal from the controller 106 can be triggered from the programmed logic of the controller 106, from the control information on the database 114 as queried by the controller 106, or from a command directed to the controller from any authorized computer 112, 120, 124, 130, or 134. The programmable logic controller 106 processes the sensor reading based on the particular sensor 102 originating the reading and control information obtained by the controller 106 from the local database 114 at step 202. The control information from the local database 114 can be queried by the controller 106 upon the receipt of each sensor reading, can be loaded into the controller 106 at the beginning of a monitoring cycle, or can be a combination of the two. The controller 106 transmits, as a default at step 216, the sensor reading data to the local database 114 for storage in a historical file for the retention of all sensor reading data. Some sensor readings, while valuable for viewing by equipment operators at the personal computer 112, may not be sufficiently important to archive, in which case these readings will be only periodically stored by the system, again by control information obtained from the local database 114 as administered by the programmable logic controller 106. Similarly, the sensor reading data is transmitted to one or more computers 112, 120, 124, 130, and 134, based on control information originally gleaned from the local database 114 and based on monitoring session information provided from the computers 112, 120, 124, 130, and 134 that have logged on to the system and have properly identified themselves to the programmable logic controller 106 as having the authority to receive sensor data and as desiring to view a particular subset of sensor data.

If a sensor 102 is identified in the local database 114 or the controller 106 as a critical sensor within the equipment 100, such as would be the case in the above example of a conveyer belt temperature sensor, the controller 106 processes the sensor reading data by comparing at step 204 the data against the standard sensor reading range limits recommended for the particular sensor 102. If the readings are out-of-range, or non-standard, or violate a predetermined minimum or maximum value, the controller generates an alarm signal at step 206. The alarm signal can be variable, depending on the sensor 102 implicated and the degree of out-of-range that has been detected. The controller can activate an audible alarm 108 in the proximity of the equipment 100 and can also activate an alarm message and an audible alarm on any online computer 112, 120, 124, 130, and/or 134 that are authorized to receive alarms triggered by the particular sensor 102. The monitoring system is configured to transmit the alarm message under contemporary protocols of communication, such as email, voice mail, SMS, WAP, and under new emerging standards in wireless technologies, such as General Packet Radio Service (hereinafter "GPRS"), Universal Mobile Telecommunications System (hereinafter "UMTS"), and 3$^{rd}$ Generation (hereinafter "3G"). With this degree of sensing and notification features, the present monitoring system can be utilized to safely permit the unsupervised and unattended operation of equipment 100.

As discussed above, one of the remote computers/terminals 130 configured and authorized to receive alarm signals can be located in a service call center, where the alarm signal is received, automatically logged, and acknowledged by the processing resources coupled to the terminal 130. Alternatively, the sensor readings received by the programmable logic controller 106 from the sensors 102 can be transmitted across the network 140 to the remote terminal 130 for processing and comparing against an acceptable range standard as stored on the terminal 130. In this embodiment, the alarm condition is determined at the location of the remote terminal 130, and a resultant alarm signal is generated from the remote terminal 130. Whether the alarm signal is generated by the controller 106 or at the remote terminal 130, one of the possible responses from the call center can be the automatic notification of a qualified field service technician, through any of the above-discussed communication means, dispatching the technician to the customer site. The system can detect if the service personnel are already at the site of the equipment problem. Alternatively, the system can transmit diagnosis and/or maintenance instructions to either the service technician or the on-site equipment operator near the computer 112 to assist in the resolution of the equipment problem signaled by the out-of-range sensor reading.

Upon receiving an alarm signal at a local personal computer 112, the on-site equipment operators or maintenance personnel can view the alarm signal information, which can include the identification of the particular sensor 102 that is out-of-range, the reading from the sensor 102, the degree to which the reading is out of range, whether a service technician has been dispatched from the call center, whether a service technician is already on site, and instructions to resolve the out-of-range condition. The programmable logic controller 106 is able to determine from the local database 114 the appropriate diagnosis or maintenance instructions to forward to service personnel or equipment operators at the personal computer 112, based on the sensor 102 that is out-of-range and the degree of deviation from an acceptable reading range or standard. An important automated management feature of one embodiment of the present invention is the ability of the programmable logic controller 106 to determine the nature of the alarm condition and automatically modify the appropriate controls on the equipment 100 to address the out-of range condition. This feature will be discussed in more detail below and is signified by steps 208 and 212 of FIG. 2.

At step 210, the on-site personnel have several options in response to an alarm condition being generated by the monitoring system, whether the alarm signal is generated by the programmable logic controller 106 or emanates from a remote terminal 130 across the network 140. The on-site personnel can access the monitoring system through the personal computer 112 to observe and review the events occurring on the equipment and its various operating parameters as reported from the sensors 102 through the controller 106 and stored in a historical log on the local database 114. If the on-site personnel have been notified through the system that service personnel have already been dispatched or on site, or if the historical log indicates service personnel are responding to the alarm, the on-site personnel need only wait for help to arrive. If no one has been dispatched, the on-site personnel can contact the remote terminal 130 at the call center through the programmable logic controller 106 and leave a message regarding the error condition on the equipment 100 and requesting assistance. The on-site personnel can also access the local database 114 or informational resources available across the network 140, such as a secured web page on the Internet, to obtain diagnostic and repair instructions for the particular error condition that has been alarmed.

Once on-site, dispatched service personnel (or the local equipment operators using instructions obtained from the monitoring system) access the equipment 100. The service personnel can activate the camera 110 through the personal computer 112 to record and/or transmit images of the equipment 100 and their maintenance on it. If no camera 110 is installed at the equipment location, the service personnel can plug a webcam into the personal computer 112 for logging the maintenance of the equipment 100. The video images from the camera 110 or webcam can be transmitted to the call center for real-time viewing of the diagnostic and repair process, with call center personnel offering real-time observations and instructions across the network 140 to repair the equipment 100 on-site. Similar monitoring and guidance can be provided through an authorized portable device 134.

A key feature of the present invention is its intelligence and ability to automatically reset the controls of the equipment 100 in response to a sensor 102 reading, whether out-of-range or simply out-of-optimum, at step 212. Should the controller 106 detect the temperature at the conveyer belt is too warm, for example, it can instruct an actuator or control 104 to increase the flow of the cryogenic gas, such as nitrogen or carbon dioxide, to lower the temperature at the level of the conveyer belt. The knowledge with which the controller 106 can make these operating command decisions is derived from the information stored on the local database 114, as loaded from the global database 126, and subsequently programmed into the controller 106 or accessed by the controller 106 upon encountering a particular non-standard condition with a sensor reading. Any such command by the controller 106 is recorded at step 214 in the local database 114 to ensure a complete history log for the equipment 100. Once the alarm condition has been resolved, whether automatically by the controller 106 or manually by service or operator personnel, the response taken to address the out-of-range condition is logged at step 214. Periodically or in real-time, this logged data is transmitted from the local database 114 to the remote global database 126 for archiving at step 216 and eventual analysis.

A wealth of services, information, and reports are available through the data and communication links of the present monitoring and control system. Some of these resources that have not yet been discussed are summarized as follows: Summary reports of all monitored equipment 100 at one or multiple sites can be generated from the global database 126, providing such information as charts of selected sensor readings across a selected time frame; productivity of the equipment 100 in terms of the count and/or weight of product processed in a selected time frame; trend data regarding production or maintenance life based on past history of the machine or like machines, even from other equipment sites; and operating summary including run time, down time, and alarms. Custom databases and reports can be built from the primary historical file on the global database 126, allowing customers limited access to information selected and formatted according to the customer' individual preferences. All reports can be accessed on demand or can be automatically generated and transmitted according to a predetermined schedule. Historical information from throughout a company or a manufacturer can be assembled and either made available centrally or disseminated to all databases 114 and 126 as the collective intelligence of the equipment 100 and/or industry.

Data can be added to the local database 114 regarding supplies and products delivered to the equipment site that are relevant to the operation of the equipment 100, such as in the above example, the amount, type, source, and quality of cryogenic gases delivered. The local database 114 can also include product safety information germane to the products in use with or in conjunction with the equipment 100. All such data is available online through authorized access from personal computers 112 and remote terminals 120, 124, 130, and 134.

An operational assistant is available for the creation of equipment operating parameters and sensor range standards. A customer with a new product to process on a particular type of available equipment 100 is granted limited access to the monitoring and control system through a remote terminal 120 or 124. The customer enters all appropriate data on for product, the specifications for the processing (such as, for cryogenic equipment, flash freezing temperature, composition of the product, thickness of the product, crust desired, and anticipated production volume). The local database 114 and/or the programmable logic controller 106 already has the characteristics of the equipment 100 to be used, the operating parameters and standards already implemented on the equipment 100, and the past history of the equipment 100. The system calculates the optimal operating parameters of the equipment 100 for processing the products with the requested properties. These calculated parameters are automatically downloaded to the local database 114 after validation by the controller 106 and are ready for access and use by the controller 106 on-site immediately. In this manner, customers can directly provide desired operating parameters for their products without risk of compromising the programmed logic of the controller 106. Should a particular site lack the production capacity to fulfill a customer's needs, the customer's operating parameters, product information, and production standards can be accessed and transmitted across the network 140 to another location for production at that location transparently to the customer.

Access to a cryogeny or other relevant expert by on-site personnel is facilitated through the personal computer 112 and a remote terminal 120, 124, 130, or 134. Such an expert may be retained by a company for all equipment sites or may be retained to be available to a particular equipment site that has experienced a high number of equipment problems. The system can determine whether any such accepted cryogeny experts are logged on to the system through any remote terminals 120, 124, 130, or 134. If an expert is logged on, an inquiry by on-site personnel through the personal computer 112 will be routed to the expert across the network 140 to the appropriate remote terminal 120, 124, 130, or 134. If no such expert is immediately available, the system can direct an inquiry message, email, or page to all qualified and retained experts for their subsequent notification, consideration, and response. These same network and communication facilities can permit an online forum in which a real-time discussion can occur with one or more experts.

The local database 114 can include a complete training file for customers and on-site personnel alike that includes a file of frequently asked questions and a full simulation for operating, maintaining, and repairing the equipment. The file can include recommended cleaning and sanitizing procedures for the equipment 100 through a choice of existing procedures and comments from to experts. The local database 114 can include a list of all manufacturer equipment 100 training programs, including locations, dates, and costs, with an online registration form. A virtual visit of the equipment can be available, utilizing the latest in virtual reality technology.

Financial resources available on the system include drafting and transmitting requests for a new quotation from an equipment salesperson. Invoicing can be handled online, with invoices being transmitted across the network 140 from a manufacturer operating a remote terminal 130 or 134 to a customer with a computer 120 or 124 in the customer's accounting department. An authorized customer can view its current invoice, payment status, and past history online through this system and can submit payment online through a secure payment system.

Authorized manufacturer personnel also have limited logon capabilities to the information available through the monitoring system and can access such information as: Summary data of all sites for a given customer or for given equipment, such as within a selected geographic area. Alarm history, including acknowledgment and dispatching of personnel in response to the alarms, by customer and/or equipment type. Maintenance records by customer, site, and/or equipment, whether preventive or curative. Custom reports for sales, engineering, and manufacturing related to equipment in use, equipment production data, and equipment down time. A request for quotation from a customer or potential customer is automatically entered into sales simulation software; and a sales engineer can validate the selection of equipment possibilities and modify some assumptions about customer production rate, type of products, etc, based on information made available from a historical file on the local database 114 or the global database 126. The system then automatically calculates the solutions corresponding to this request and helps price them.

Although preferred embodiments of the present invention have been shown and described, it will be appreciated by those skilled in the art that changes may be made in these embodiments without departing from the principle and spirit of the invention, the scope of which is defined in the appended claims and their equivalents.

What is claim is:

1. A method for remote monitoring of equipment, comprising:

generating sensor readings from at least one sensor on a piece of equipment;

transmitting the sensor readings to a processor;

accessing the transmitted sensor readings, wherein access to the readings is limited based on one or more of a user logon identifier, a user status identifier, and the processor location;

processing the transmitted sensor readings against a predetermined standard to determine whether any transmitted sensor readings violate the standard; and automatically transmitting a signal to the equipment site should any of the transmitted sensor readings violate the standard.

2. The method according to claim 1, wherein the sensor measures one or more of equipment operating conditions, equipment environmental conditions, and product characteristics.

3. The method according to claim 1, wherein the sensor readings are transmitted to a processor remote from the equipment location.

4. The method according to claim 1, further including the step:

automatically transmitting commands to the equipment to modify equipment control settings so that the equipment sensor readings will comply with the predetermined standard.

5. The method according to claim 1, wherein the processor is a programmable logic controller serving as an interface between the equipment sensor and users.

6. The method according to claim 1, wherein the predetermined standard has been established by analyzing a plurality of prior sensor readings from like equipment.

7. The method according to claim 6, wherein the predetermined standard is maintained at a global location and is transmitted to the location of the equipment for local processing against the generated equipment sensor readings.

8. The method according to claim 1, wherein the sensor readings violate the standard if the sensor readings are out-of-range, violate a minimum or a maximum sensor reading value, or exceed a standard sensor reading range.

9. The method according to claim 1, wherein the transmitted signal comprises an alarm signal and maintenance instructions.

10. The method according to claim 1, wherein the step of transmitting a signal further includes transmitting an alarm signal to a location remote from the equipment.

11. The method according to claim 1, further comprising the step of automatically generating a signal to a call center located remote from the equipment if any of the sensor readings violate the standard, wherein said signal comprises information regarding the location of the equipment and the nature of an equipment service requirement.

12. The method according to claim 11, wherein a video connection is established between the equipment site and the call center location.

13. A method for automated monitoring of equipment, comprising:

generating sensor readings from one or more sensors on a piece of equipment, said sensors automatically reading one or more operating conditions of the equipment;

transmitting the sensor readings to a site physically remote from the equipment;

accessing the transmitted sensor readings, wherein access to the readings is limited based on one or more of a user logon identifier, a user status identifier, and the location of the remote site;

processing the transmitted sensor readings against a predetermined standard to determine whether any transmitted sensor readings violate the standard, wherein if any reading violates the standard an alarm signal is automatically generated;

storing all transmitted sensor readings and all generated alarm signals; and automatically transmitting maintenance instructions to the equipment site should any of the transmitted sensor readings violate the predetermined standard.

14. A system for remote monitoring of equipment, comprising:

a sensor for generating sensor readings from a piece of equipment;

a first transmitter for transmitting the sensor readings to a processor;

a processor for comparing the transmitted sensor readings against a predetermined standard to determine whether any transmitted sensor readings violate the standard, wherein access to the transmitted sensor readings is limited based on the location of the processor; and a second transmitter for automatically transmitting a signal to the equipment site should any of the transmitted sensor readings violate the standard.

15. The system according to claim 14, wherein the transmitted signal is an alarm signal.

16. The system according to claim 14, wherein the generated sensor readings are stored locally at the location of the piece of equipment and are stored globally at a location remote from the piece of equipment.

17. A method for automated control of equipment, comprising:

determining desired performance standards for a piece of equipment;

generating sensor readings from the piece of equipment;

comparing the generated sensor readings against the desired performance standards, wherein access to the generated sensor readings is authorized based on one or more of a user logon identifier, a user status identifier, and a remote processor location;

transmitting commands to set operating controls on the equipment should the generated sensor readings violate the desired performance standards, wherein the transmitted commands are determined based on prior sensor readings and operating control settings from like pieces of equipment and wherein the transmitted commands automatically set operating controls on the piece of equipment such that the desired performance standards are achieved.

18. The method according to claim 17, wherein the desired performance standards are determined at a central location based on sensor readings transmitted from like pieces of equipment to the central location.

19. The method according to claim 18, wherein the determined performance standards include operating control settings known to achieve certain sensor readings on like equipment.

20. The method according to claim 17, wherein the sensor readings are transmitted to a processor remote from the location of the piece of equipment and the steps of comparing readings and transmitting commands are performed by the remote processor.

21. The method according to claim 20, wherein the remote processor is authorized to transmit the commands based on one or more of a user logon identifier, a user status identifier, and a remote processor location.

22. The method according to claim 17, wherein the transmitted commands will cause the shutdown of the piece of the equipment if the generated sensor readings violate the desired performance standards by a predetermined amount.

23. A system for automated control of equipment, comprising:

a first processor for determining desired performance standards for a piece of equipment;

a sensor for generating sensor readings from the piece of equipment;

a second processor for comparing the generated sensor readings against the desired performance standards, wherein access to the generated sensor readings is limited based on the location of the second processor;

a transmitter for transmitting commands to set operating controls on the equipment should the generated sensor readings violate the desired performance standards, wherein the transmitted commands are determined based on prior sensor readings and operating control settings from like pieces of equipment and wherein the transmitted commands automatically set operating controls on the piece of equipment such that the desired performance standards are achieved.

* * * * *